United States Patent [19]

Fidi

[11] Patent Number: 4,501,462

[45] Date of Patent: Feb. 26, 1985

[54] COUPLING MEMBER FOR A CAPACITIVE MICROPHONE

[75] Inventor: Werner Fidi, Baden, Austria

[73] Assignee: AKG Akustische u.Kino-Gerate Gesellschaft m.b.H, Austria

[21] Appl. No.: 427,561

[22] Filed: Sep. 29, 1982

[30] Foreign Application Priority Data

Oct. 15, 1981 [AT] Austria ..... 4433/81

[51] Int. Cl.[3] ..... H01R 33/12

[52] U.S. Cl. ..... 339/93 R; 339/DIG. 3; 339/177 R; 339/217 R; 339/218 M

[58] Field of Search ..... 339/177 E, 93, 94, DIG. 3

[56] References Cited

U.S. PATENT DOCUMENTS 2,379,942 7/1945 Webber ..... 339/DIG. 3
3,278,890 10/1966 Cooney ..... 339/93 C
4,074,926 2/1978 Broad ..... 339/DIG. 3

FOREIGN PATENT DOCUMENTS 2621065 12/1976 Fed. Rep. of Germany ... 339/DIG. 3

*Primary Examiner*—Eugene F. Desmond
*Assistant Examiner*—David L. Pirlot
*Attorney, Agent, or Firm*—McGlew and Tuttle

[57] ABSTRACT

A coupling member for coupling a capacitive microphone capsule to a preamplifier housing to form a rod-shaped microphone assembly, comprises a shaped body made of vibration absorbing elastic electrically conducting material. A contact pin extends axially in the shaped body and has at least a portion made of vibration absorbing elastic electrically conductive material. The shaped body and contact pin form first and second electrical connections between the capacitive microphone and the preamplifier. In this way noise which is transmitted through the solid body of the amplifier does not reach the capacitive microphone to generate objectionable low-frequency sounds.

16 Claims, 2 Drawing Figures

COUPLING MEMBER FOR A CAPACITIVE MICROPHONE

FIELD AND BACKGROUND OF THE INVENTION

The present invention relates in general to microphones and in particular to a new and useful coupling member for capacative microphones.

Rod or generally cylindrically shaped microphone assemblies incorporate a capacitive michrophone and a preamplifier. A coupling member is detachably connected between the capacitive microphone and preamplifier by a screw thread connection, a plugging connection or the like.

Such coupling members are known per se and, in general, are intended for connecting microphone capsules of various types to a respective suitable microphone preamplifier. The problem underlying the present invention, however, is different. The coupling member is to be of a design which prevents sound which is transmitted through solids, from passing from the housing of the preamplifier to the microphone capsule, without substantially increasing the volume of the microphone.

To prevent solid-borne noise caused by movements of a cable connected to the housing or by vibrations of the microphone casing, which pass to the transducer diaphragm where they produce electrical, disturbing, low-frequency oscillations, it is known to suspend the capacitive transducer in a resiliently damping manner within the microphone housing. A resilient mounting of this kind is described in German AS No. 14 37 433, for example. such a resilient mounting substantially comprises elastic, vibration-absorbing rings enclosing the electroacoustic transducer and fitted by their outer circumference into the microphone housing. Such a mounting has the disadvantage of considerably enlarging the volume of the housing and making it impossible to design the microphone housing in the shape of a slender cylindrical rod to be accommodated as inconspicuously as possible, for example during transmissions of theater productions, etc.

SUMMARY OF THE INVENTION

The present invention is directed to a rod-shaped capacitive microphone that is substantially cylindrical throughout and which is to a large extent insensible to sound that is transmitted through solids. To this end, it is provided, in accordance with the invention, that the above-mentioned coupling member has components which are made of elastic electrically conductive material.

Accordingly, an object of the invention is provide a coupling member for coupling a microphone capsule to a preamplifier which comprises a shaped body of vibration-absorbing elastic electrically conducting material for forming a first conductive connection between the capsule and the preamplifier, a contact pin including at least a portion made of vibration absorbing elastic electrically conducting material, extending axially in the shaped body for forming a second conductive connection between the capsule and the preamplifier, and connection means for connecting one end of the shaped body to the capsule and an opposite end of the shaped body the preamplifier.

The invention is based on the idea of providing the absorbing elastic mounting means outside the microphone housing, which results in a very simple construction in no way affecting the design of the housing as a slender, rod-shaped body, and ensuring the desired attenuation of structure-borne sound at the same time. Since the material of the shaped body is electrically conducting, this property is utilized for establishing an electrical connection between the microphone capsule and the preamplifier. Another electrical connection is then established through a contact pin which is located within the coupling member in central axial position and comprises a portion which again is made of a vibration-absorbing, elastic and electrically conducting material, so that no solid-borne sound can pass through the pin either. This contact pin may be a loose component part of the coupling member, or it may be mounted within the coupling member through a plate or diaphragm of a non-conducting material. This latter design has the advantage that the contact pin cannot get lost, while the design with a loose contact pin is simple and thus less expensive.

The coupling member designed as a resilient connecting piece performs the function of a mechanical filter, dissipating to the largest extent, the prevailing noise energy, so that hardly any low-frequency noise oscillations are transmitted to the diaphragm of the capacitive microphone accommodated in the capsule. Advantageously, the sound-absorbing connecting piece may be designed for conveying to the diaphragm, over the entire transmission range of 20 Hz to 20kHz of the capacitive microphone, as little nois energy as possible. This is obtained, in accordance with the invention, by providing that the elastic material for absorbing vibrations and used for the connecting part exhibits an internal mechanical friction which is frequency dependent and decreases with increasing frequency. The oscillatory system formed by the mass of the microphone capsule and the elastic coupling member has its natural frequency in the lower transmission range of the capacitive microphone and requires a strong attenuation within this range if a solid-borne sound transmission is to be avoided. It is well known that above the $\sqrt{2}$-fold resonance frequency, a strongly damped oscillatory system for noise energies is more responsive to excitation than an oscillatory system which is damped only slightly or not at all. Therefore, with a frequency-dependent damping decreasing with the frequency increase, the noise energy is suppressed most effectively.

As already mentioned, it is further intended to make the coupling member of an electrically conducting material and thus to simplify the construction by omitting other electrically connecting parts. The invention therefore provides for the use of butyl rubber, bromobutyl rubber or nitrile rubber as the electricity conducting material for the coupling member.

A further object of the invention is to provide a coupling member for substantially rod-shaped microphone assemblies which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
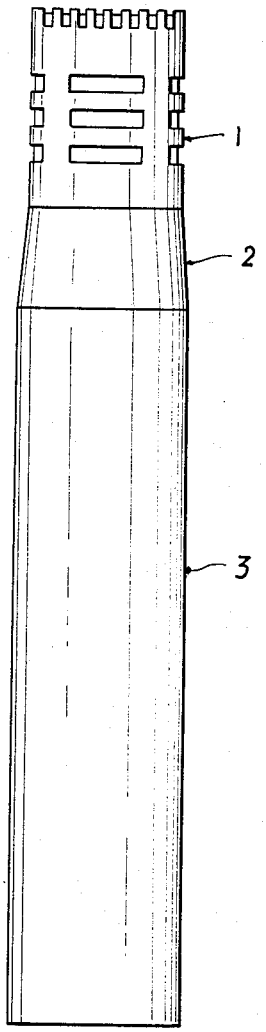
FIG. 1 is a side elevational view of a rod-shaped capacitive microphone including the inventive coupling member.

Referring to the drawings, in particular, FIG. 1 shows a coupling member 2 which is provided between a microphone capsule or transducer 1 and the housing of a preamplifier 3, which causes only a slight, not disturbing, extension of the microphone. Coupling member 2 may even be used as a transition compensating piece for differences in diameter between the microphone capsule 1 and the preamplifier housing 3, as illustrated in FIG. 1.

Figure 2:
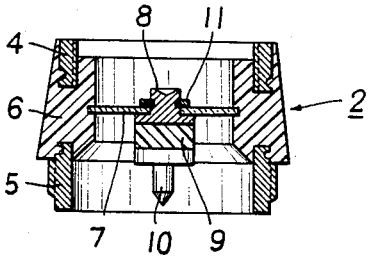
FIG. 2 is a sectional view of the coupling member.

The coupling member itself is shown in FIG. 2 in a partly sectional view. In the shown embodiment, it is assumed that the microphone capsule is connected to the coupling member by a screw thread and that the coupling member is connected to the preamplifier housing in the same way. However, a plug connection or a bayonet joint, or even a magnetic connection may be provided as well. In the shown example according to FIG. 2, the coupling member comprises an upper threaded ring 4 and a lower threaded ring 5. These rings are connected to each other by a shaped body 6 made of a vibration-absorbing, elastic, and electrically conducting material. Threaded rings 4,5 may be vulcanized to body 6, but they also may be connected thereto by an electrically conducting adhesive. A centrally located and axially extending contact pin 10 is supported by a plate 7 which is peripherally anchored in body 6. Plate 7 must be made of an insulating material, otherwise the two conductive paths from the microphone would be shorted. Advantageously, the ground connection will be provided in the in the externally extending body 6, and contact pin 10, which is connected to a contact button 8 through an elastic and electrically conducting cylinder 9, will be used as the live connection.

It is assumed in this design, that the electroacoustic transducer 1 comprises a downwardly projecting contact pin (not shown), so that pin 10 terminates within coupling member 2 in a contact button 8. To prevent the contact pin from axial displacement, a spring washer 11 is provided cooperating with plate 7 and securing the pin. Button 8 also has a recess in the top thereof for a contact pin of transducer 1.

While a specific embodiment of the invention has been shown and described in detail to illustrate the application of the principles of the invention, it will be understood that the invention may be embodied otherwise without departing from such principles.

What is claimed is:

1. A combination microphone capsule, preamplifier and coupling member for coupling the microphone capsule to the preamplifier, comprising:

a microphone capsule;

a preamplifier;

a shaped body of vibration-absorbing elastic electrically conducting material connected between said capsule and preamplifier for forming a first conductive connection between said capsule and said preamplifier;

a contact pin connected between said capsule and preamplifier and including at least a portion made of vibration-absorbing elastic electrically conducting material, said contact pin extending axially in said shaped body for forming a second conductive connection between said capsule and said preamplifier; and connection means connected to said shaped body for connecting one end of said shaped body to said capsule and an opposite end of said shaped body to said preamplifier;

wherein said shaped body has an axially extending opening therethrough, said coupling member including a diaphragm made of electrically insulating material and having an aperture therethrough said diaphragm mounted in said shaped body opening and connected to said shaped body, and abutting said contact pin for supporting said contact pin in said shaped body, said contact pin engaged in said aperture and spaced radially inwardly of said shaped body.

2. A combination according to claim 1, wherein said microphone capsule and said preamplifier with the connected coupling member form a substantially rod-shaped assembly, said coupling member forming a transition between said microphone capsule and said preamplifier.

3. A combination according to claim 1, wherein said contact pin extends centrally and axially in said shaped body.

4. A combination according to claim 1, wherein said vibration-absorbing elastic electrically conducting material exhibits internal friction which decreases with increasing frequency of sound transmitted to said material.

5. A combination according to claim 1, wherein said vibration absorbing elastic electrically conducting material is chosen from the group consisting of butyl rubber, bromobutyl rubber and nitrile rubber.

6. A combination according to claim 1, wherein said contact pin comprises a button having a small diameter portion extending through said aperture in said diaphragm, a spring washer connecting said button portion to said diaphragm, a contact pin portion and a connecting part made of vibration absorbing elastic electrically conducting material connected between said button portion and said contact pin portion.

7. A coupling member according to claim 6, wherein said button portion has a recess therein and said contact pin portion has a pointed end.

8. A coupling member for coupling a microphone capsule to a preamplifier comprising:

a shaped body of vibration-absorbing elastic electrically conducting material for forming a first conductive connection between the capsule and the preamplifier and for supporting the capsule on the preamplifier, said shaped body having an upper end for connection to the capsule and a lower end for connection to the preamplifier, said upper and lower ends connected to each other only through said shaped body and being spaced from each other;

a second conductive connection between the capsule and the preamplifier comprising a contact pin, a conducting portion made of vibration-absorbing elastic electrically conducting material connected to said contact pin and a capsule engaging portion connected to said conducting portion, said pin, said conducting portion and said capsule engaging portion extending axially and in series in said shaped body, said conducting portion separating and spacing said contact pin from said capsule engaging portion so that said contact pin does not directly engage said capsule engaging portion; and connection means connected to said shaped body for connecting one end of said shaped body to the capsule and an opposite end of said shaped body to the preamplifier with the capsule supported on the preamplifier only over said shaped body.

9. A coupling member according to claim 8, wherein the microphone capsule and the preamplifier with the connected coupling member form a substantially rod-shaped assembly, said coupling member forming a resilient transition between the microphone capsule and the preamplifier.

10. A coupling member according to claim 8, wherein said vibration-absorbing elastic electrically conducting material exhibits internal friction which descreases with increasing frequency of sound transmitted to said material.

11. A coupling member according to claim 8, wherein said vibration absorbing elastic electrically conducting material is chosen from the group consisting of butyl rubber, bromobutyl rubber and nitrile rubber.

12. A coupling member according to claim 8, wherein said connection means comprises a first threaded ring connected to one end of said shaped body and a second threaded ring connected to an opposite end of said shaped body.

13. A coupling member according to claim 8, wherein said contact pin extends centrally and axially in said shaped body.

14. A coupling member according to claim 13, wherein said shaped body has an axially extending opening therethrough, said coupling member including a diaphragm made of electrically insulating material mounted in said shaped body opening and connected to said contact pin for supporting said second conductive connection in said shaped body.

15. A coupling member according to claim 14, wherein said capsule engaging portion comprises a button having a small diameter portion extending through an opening in said diaphragm, a spring washer connecting said button portion to said diaphragm.

16. A coupling member according to claim 15, wherein said button portion has a recess therein and said contact pin has a pointed end.

* * * * *